US008779942B1

(12) United States Patent
Potter et al.

(10) Patent No.: US 8,779,942 B1
(45) Date of Patent: Jul. 15, 2014

(54) BICYCLE DETECTOR WITH IMPROVED DETECTION USING SIGNATURE ANALYSIS

(75) Inventors: Thomas Ray Potter, Reno, NV (US); Jason Zhen-Yu Lu, Sparks, NV (US)

(73) Assignee: Reno A & E, Reno, NV (US)

( * ) Notice: Subject to any disclaimer, the term of this patent is extended or adjusted under 35 U.S.C. 154(b) by 169 days.

(21) Appl. No.: 13/573,118

(22) Filed: Aug. 23, 2012

(51) Int. Cl.
*G08B 21/00* (2006.01)

(52) U.S. Cl.
USPC ..... 340/933; 340/941

(58) Field of Classification Search
CPC ..... G08G 1/042
USPC ..... 340/933, 939, 941; 324/236, 654, 655
See application file for complete search history.

(56) References Cited

U.S. PATENT DOCUMENTS 5,652,577 A * 7/1997 Frasier ..... 340/933

* cited by examiner

*Primary Examiner* — Jeffery Hofsass

(57) ABSTRACT

A vehicle detector detects bicycles and discriminates between a bicycle and a motorized vehicle using a specific signature analysis technique when operated in the bicycle detect mode and the bicycle only detect mode. The signature analysis technique employs two sets of rules: one set for a bicycle which produces a signature having at least two peaks and two valleys when passing over a loop connected to the vehicle detector; the other for a bicycle which produces a signature having two peaks and only one valley when passing over a marginal side region of a loop connected to the vehicle detector. Peak and valley searches are conducted sequentially, with a peak search being conducted first upon start-up.

17 Claims, 12 Drawing Sheets

BICYCLE DETECTOR WITH IMPROVED DETECTION USING SIGNATURE ANALYSIS

REFERENCE TO COMPUTER PROGRAM LISTING

This application includes a computer program listing appendix submitted on the accompanying compact disc containing a single file entitled "BicycleDetector7-6-12.txt" created on Jul. 6, 2012 and having a file size of 2,826 Kbytes. Two discs having identical copies of the file accompany this application and are identified as "Copy 1" and "Copy 2". The material contained on each disc is hereby incorporated by reference.

BACKGROUND OF THE INVENTION

This invention relates to vehicle detector systems used to detect the presence or absence of a motor vehicle over an inductive loop embedded in the pavement. More particularly, this invention relates to a vehicle detector system using a signature analysis technique capable of detecting both motorized vehicles and bicycles for purposes of traffic control and for distinguishing bicycles from motorized vehicles.

Vehicle detectors have been used for a substantial period of time to generate information specifying the presence or absence of a vehicle at a particular location sometimes termed a detection zone. Such detectors have been used at intersections, for example, to supply information used by an associated traffic control unit to control the operation of the traffic signal heads, and have also been used to supply control information used in conjunction with automatic entrance and exit gates in parking lots, garages and buildings. A widely used type of vehicle detector employs the principle of period shift measurement in order to determine the presence or absence of a vehicle in or adjacent to the inductive loop mounted on or in a roadway. In such systems, a first oscillator, which typically operates in the range from about 20 kHZ to about 100 kHZ is used to produce a periodic signal in a vehicle detector loop. A second oscillator operating at a much higher frequency is commonly used to generate a sample count signal over a fixed number of loop cycles. The relatively high frequency count signal is typically used to increment a counter, which stores a number corresponding to the sample count at the end of the fixed number of loop cycles. This sample count is compared with a reference count stored in another counter and representative of a previous count in order to determine whether a vehicle has entered or departed the region of the loop in the time period between the previous sample count and the present sample count.

The initial reference value is obtained from one or more initial sample counts and stored in a reference counter. Thereafter, successive sample counts are obtained on a periodic basis, and compared with the reference count. If the two values are essentially equal, the condition of the loop remains unchanged, i.e., a vehicle has not entered or departed the loop. However, if the two numbers differ by at least a threshold amount in a first direction (termed the Call direction), the condition of the loop has changed and may signify that a vehicle has entered the loop. More specifically, in a system in which the sample count has decreased and the sample count has a numerical value less than the reference count by at least a threshold magnitude, this change signifies that the period of the loop signal has decreased (since fewer counts were accumulated during the fixed number of loop cycles), which in turn indicates that the frequency of the loop signal has increased, usually due to the presence of a vehicle in or near the loop. When these conditions exist, the vehicle detector generates a signal termed a Call signal indicating the presence of a vehicle in the loop.

Correspondingly, if the two numbers differ by less than a second threshold amount in a second direction (termed the No Call direction), this condition indicates that a vehicle which was formerly located in or near the loop has departed the detection zone. When this condition occurs, a previously generated Call signal is dropped.

The difference $\Delta N$ between a sample count N and a reference count R is representative of the inductance change in a loop circuit at the end of the time period between the former sample count (the reference count R) and the current sample count N. More particularly, the quantity $\Delta L/L=k\ \Delta N/N$, where L=loop inductance and k is a scaling factor, expresses the relationship between numerical counts and loop inductance.

The Call signal can be either a pulse signal or a presence signal. A pulse signal is a fixed length pulse generated when the vehicle is detected in the loop. A presence signal is a signal which continually persists so long as the vehicle remains in the loop. Some vehicle detectors are provided with a presence/pulse selection feature, which causes the vehicle detector to generate one of these two types of Call signals.

Call signals are used in a wide variety of applications, including vehicle counting along a roadway or through a parking entrance or exit, vehicle speed between preselected points along a roadway, vehicle presence at an intersection controlled by a traffic control light system, or in a parking stall, and numerous other applications.

In addition to the basic function of generating and dropping a Call signal, existing vehicle detectors incorporate other features, some of which are selectable on-site by a technician. For example, some vehicle detectors incorporate an end of green function which requires the detector to automatically reset after the green traffic signal, which controls the lane in which the loop associated with the vehicle detector is located, terminates. Some vehicle detectors are provided with an extension time feature which extends the Call signal for a period of time after a vehicle leaves the associated loop (typically in order to permit ample minimum time for a vehicle to clear an intersection). Some vehicle detectors are also provided with a presence/pulse selection feature, which causes the vehicle detector to generate one of two types of Call signals: a continually persisting signal so long as the vehicle remains in the loop (the presence function); or a fixed length pulse generated when the vehicle is first detected in the loop, or when the vehicle departs the loop (the pulse function). Still other vehicle detectors are provided with selectable different sensitivity settings, which enable a technician to adjust the response of the vehicle detector when connected to the loop in order to accommodate a range of detection conditions.

In the past, vehicle detectors have been designed as either single channel or multiple channel detectors. A single channel detector is designed and configured to operate with only a single loop zone; while a multiple channel vehicle detector is designed and configured to operate with two or more independent loop zones. Multiple channel detectors are designed to be either scanning or non-scanning detectors. A scanning detector operates by sampling only one loop channel at a time, shutting down the active loop, sampling the next loop channel, shutting down that loop, etc. Scanning detectors are typically used in installations in which the probability of cross-talk between loop circuits is more than minimal. Cross talk results when physically adjacent loops are operating at, or near, the same frequency. Cross talk is minimized or eliminated by operating physically adjacent loops on different frequencies. Non-scanning vehicle detectors are configured and function to monitor each of the multiple loop zones simultaneously. Non-scanning detectors are typically used in installations in which there is a very low or no possibility of cross-talk between the multiple loop circuits, such as installations at which the loops are physically separated by a distance sufficient to ensure no overlapping or inter-coupling between the electrical fields associated with the loops. An example of a vehicle detector incorporating the functions described above is disclosed in U.S. Pat. No. 6,087,964 issued Jul. 11, 2000 for "Vehicle Detector With Operational Display", the disclosure of which is hereby incorporated by reference.

When deployed in an intersection controlled by a traffic control light system, vehicle detectors generate signals which are used by the intersection traffic controller to supervise the operational states of the traffic control heads in response to the arrival and departure of vehicles over loops installed in the various lanes leading to the intersection. One of the key parameters required for the orderly progression of vehicles through an intersection is the clearance time provided for motorized vehicles present at the intersection. In known traffic control systems, the clearance time value is usually selected to allow a motorized vehicle (i.e. an auto, truck, or motorcycle) sufficient time to safely proceed through an intersection when a green phase is presented to a vehicle, without unnecessarily lengthening the duration of the green phase. While this technique works well for motorized vehicles, bicycles present a problem due to the fact that a bicycle typically requires a longer period of time to safely proceed through an intersection than a motorized vehicle. While this problem can be addressed by simply lengthening the period of the initial time and the extension time for all vehicles, this solution is not satisfactory since it inordinately lengthens the duration of the green phase, regardless of whether or not a bicycle is present at an intersection waiting for the green phase to proceed.

Commonly-assigned, co-pending U.S. patent application Ser. No. 13/385,035 filed Jan. 30, 2012 for "Bicycle Detector", the disclosure of which is hereby incorporated by reference, discloses a vehicle detector which is capable of detecting motorized vehicles and bicycles, which is capable of discriminating between a bicycle and a motorized vehicle, and which is capable of providing the longer clearance time required by a bicycle to safely proceed through a controlled intersection when a bicycle is present while providing the normal clearance time for motorized vehicles present at the same intersection when no bicycle is present. Bicycle detection is provided according to the invention disclosed in the referenced Patent Application using one of two different techniques. In a first technique, a maximum bicycle threshold value Bmax stored in the vehicle detector memory is examined whenever a vehicle has been detected by the vehicle detector. If the maximum value of the measured $-\Delta L/L$ is less than Bmax but greater than a minimum threshold greater than zero (0.001% in the preferred embodiment), the vehicle is identified as a bicycle. If the maximum value of the measured $-L/L$ is equal to or greater than Bmax, the vehicle is identified as a motorized vehicle (i.e., a vehicle other than a bicycle).

In a second bicycle detection technique, a signature analysis is performed using the $-\Delta L/L$ values obtained during the vehicle detection process. This is illustrated in FIGS. 4A and 4B of the referenced Patent Application, which are included as FIGS. 4A and 4B of this application. FIG. 4A is a plot of the measured values of $-\Delta L/L$ (Y-axis) over a period of time (X-axis) for a motorized vehicle passing over a loop. As is evident from this Fig., the plot has a single lobe which is nearly symmetric. FIG. 4B is a plot of the measured values of $-\Delta L/L$ over a period of time for a standard bicycle passing over the same loop. As is evident from this Fig., the plot has a central large lobe flanked by two smaller lobes. The difference in shapes between the two plots provides sufficient information to distinguish between a motorized vehicle and a standard bicycle.

[add parallogram loop ref/]

SUMMARY OF THE INVENTION

The invention comprises a vehicle detector capable of improved detection and discrimination between bicycles and motorized vehicles using a specific signature analysis technique, and which is capable of detecting motorized vehicles and bicycles, which is capable of discriminating between a bicycle and a motorized vehicle, and which is capable of providing the longer clearance time required by a bicycle to safely proceed through a controlled intersection when a bicycle is present while providing the normal clearance time for motorized vehicles present at the same intersection when no bicycle is present.

From an apparatus standpoint, the invention comprises a vehicle detector with bicycle detect and discrimination capability using signature analysis, the vehicle detector comprising an oscillator adapted to be coupled to a loop; a memory; and a processor operatively coupled to the oscillator and the memory. The memory has machine readable code stored therein configured to enable the processor to activate the oscillator to produce a signal for the loop, to implement a loop cycle counter for counting a predetermined number of loop oscillator cycles defining a sample period, to implement a sample counter for accumulating sample counts N during the predetermined number of loop oscillator cycles; to implement a reference counter for storing a reference count R based on the accumulated sample counts from a previous sample period; to implement an evaluation unit for determining from the sample counts N and the reference count R whether a vehicle has entered the loop during the sample period and for determining from the sample counts N and the reference count R whether a detected vehicle is a bicycle; and to implement a Call signal generator for generating a Call signal when the evaluation unit has determined that a vehicle has entered the loop during the sample period. The machine readable code is further configured to enable the evaluation unit to determine whether a detected vehicle is a bicycle by successively detecting peaks and valleys in a signature formed by a collection of sample counts N and at least one reference count R, testing each detected peak and valley against a first set of rules, and generating a "Has Bike" signal when two peaks and two valleys satisfy the first set of rules.

In the preferred embodiment, the first set of rules comprises:

Rule 1 (used to detect a first valid peak):

$$K1 \leq \text{peak } 1 \leq K2$$

where K1 is a constant lying in the range from 30-50 (preferably 40);

K2 is a constant lying in the range from 280-320 (preferably 300); and peak 1 is the (R−N) value at peak 1;

Rule 2 (used to detect a first valid valley):

$$K3 \leq \text{valley } 1 \leq 0.625 \times \text{peak } 1$$

where K3 is a constant lying in the range from 10-20 (preferably 12);

valley 1 is the (R−N) value at valley 1; and peak 1 is the (R−N) value at peak 1;

Rule 3 (used to detect a second valid peak):

$$1.125 \times \text{peak } 1 \leq \text{peak } 2 \leq K4$$

where peak 1 is the (R−N) value at peak 1; peak 2 is the (R−N) value at peak 2; and K4 is a constant lying in the range from 360-440 (preferably 400);

Rule 4 (used to detect a second valid valley):

$$K5 \leq \text{valley } 2 \leq \text{peak } 2 - [0.375 \times \text{peak } 1]$$

where K5 is a constant lying in the range from 10-20 (preferably 12);

valley 2 is the (R−N) value at valley 2; peak 2 is the (R−N) value at peak 2; and peak 1 is the (R−N) value at peak 1.

The machine readable code is further configured to enable the processor to implement a bicycle timer which is activated to count toward a zero value state from a predetermined non-zero value when a first valid peak has been detected by the evaluation unit and to enable the processor to prevent the generation of the "Has Bike" signal by the evaluation unit when the bicycle timer has reached the zero value state before the first set of rules is satisfied.

The machine readable code is further configured to enable the evaluation unit to determine whether a loop disturbance caused by an object entering the vicinity of the loop has occurred and to perform the peak and valley detection and testing so long as the loop disturbance is present.

The machine readable code is further configured to enable the evaluation unit to determine whether a formerly present loop disturbance is no longer present and to generate the "Has Bike" signal when two peaks and one valley satisfy the first set of rules after the formerly present loop disturbance is no longer present.

The machine readable code is further configured to enable the evaluation unit to determine whether a formerly present loop disturbance is no longer present and to generate the "Has Bike" signal when two peaks and one valley do not satisfy said first set of rules but do satisfy a second set of rules after the formerly present loop disturbance is no longer present.

In the preferred embodiment, the second set of rules comprises:

Rule 1 (used to detect a first valid peak):

$$K6 \leq \text{peak } 1 \leq K7$$

where K6 is a constant lying in the range from 30-50 (preferably 40); peak 1 is the (R−N) value at peak 1; and K7 is a constant lying in the range from 380-420 (preferably 400).

Rule 2 (used to detect a valley):

$$\text{Valley} \leq 12$$

where Valley is the (R−N) value at the valley

Rule 3 (used to detect a second valid peak):

$$K6 \leq \text{peak } 2 \leq K7$$

where K6, K7 are as defined above and peak 2 is the (R−N) value at peak 2.

Rule 4:

The valley value is compared with the average value of the two peaks, i.e.

$$\text{Peak Average} = \frac{\text{peak } 1 + \text{peak } 2}{2}$$

If Valley≤0.625 Peak Average, then a bicycle is present and the "Has Bike" flag is set.

The machine readable code is further configured to enable the processor to implement a bicycle timer which is activated to count toward a zero value state from a predetermined non-zero value when a first valid peak has been detected by the evaluation unit and to enable the processor to prevent the generation of the "Has Bike" signal by the evaluation unit when the bicycle timer has reached the zero value state before the second set of rules is satisfied.

When installed, the vehicle detector oscillator is coupled to a loop, which has a geometrical configuration capable of producing a bicycle signature having at least two peaks and two valleys when a bicycle passes over a loop connected to the vehicle detector, and also a bicycle signature having at least two peaks and one valley when a bicycle passes over a marginal side region of the loop. The loop is preferably configured in the shape of a parallelogram, and the parallelogram loop preferably extends across a traffic lane monitored by the vehicle detector to which the loop is connected. The parallelogram loop has two opposing sides which are substantially coincident with opposing edges of the traffic lane, and two long parallel legs mutually spaced by an amount which matches the approximate spacing between the front and rear wheels of a bicycle.

The invention provides a bicycle detect and discrimination capability based on signature analysis as well as a motorized vehicle detection capability. The signature analysis technique, when combined with a loop having a geometry capable of producing signatures of the types just described and shown in FIGS. 4A-4D described below, provides bicycle detection and discrimination between bicycles and motorized vehicles with a reliability approaching 100%. In addition, the use of the two sets of rules enables the reliable detection of not only bicycles passing through the major area of the loop, but also bicycles passing over the loop closely adjacent the short edges. Consequently, the probability of a bicycle passing over the loop and not being detected is close to zero.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
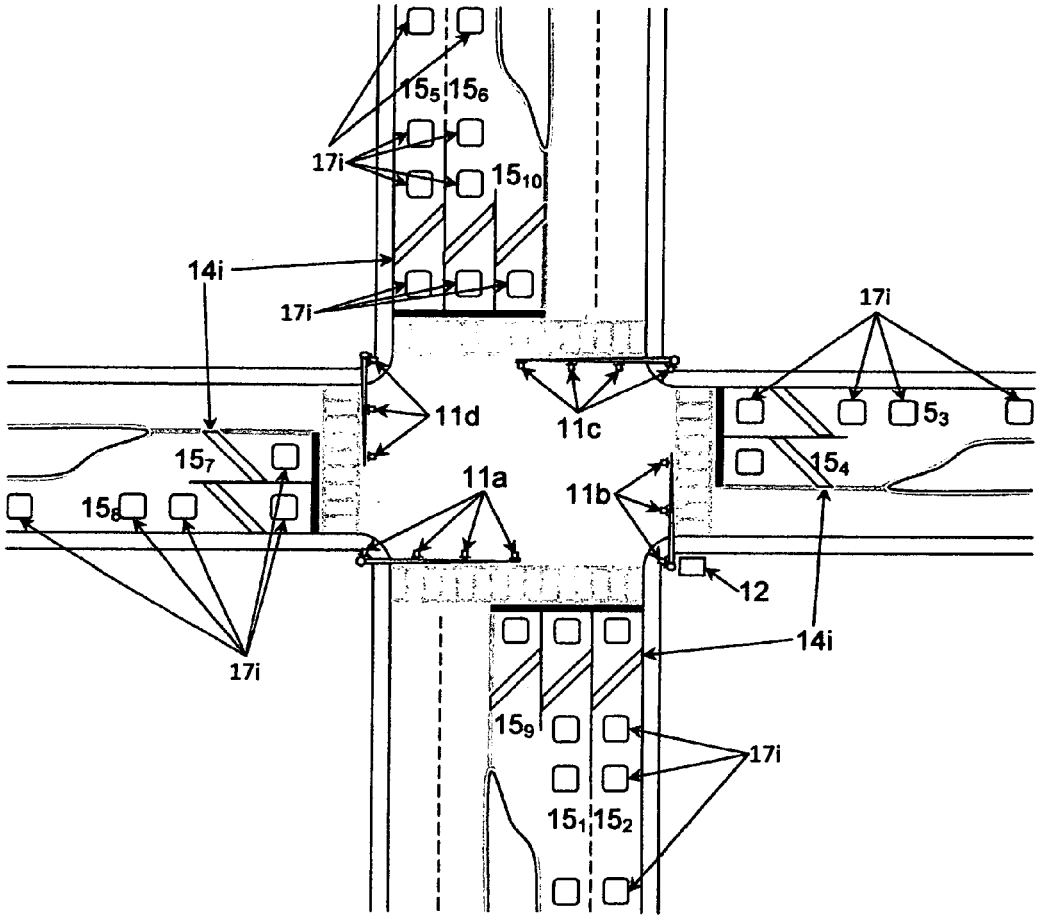
FIG. 1 is a schematic aerial view of a controlled 4-way intersection.

Turning now to the drawings, FIG. 1 is a schematic aerial view of a controlled 4-way vehicle traffic intersection. The intersection is provided with four sets of control heads 11*a*-11*d* each containing the usual traffic lights for providing red, amber, and green traffic control signals for oncoming vehicles. The operation of each set of control heads is under the supervision of a standard traffic controller 12 mounted in a cabinet located at a convenient intersection location. The traffic controller 12 has a plurality of output circuits for driving the individual traffic lights comprising each set of control heads 11*a*-11*d*. A plurality of vehicle detectors (not illustrated) is located in the same cabinet as traffic controller 12 and each vehicle detector provides motorized vehicle and bicycle CALL signals to traffic controller 12 in the manner described below, along with timing signals for INITIAL TIME and EXTENSION TIME described more fully below. Each vehicle detector configured to detect bicycles and discriminate between bicycles and motorized vehicles is coupled to one or more vehicle detector loops 14*i* located in the various lanes leading to the intersection. In the preferred embodiment, loops 14*i* are parallelogram loops having the geometry described in detail below and located in a position upstream from the intersection. Some of the loops 14*i* are located in through-only lanes-such as lanes 15-1-15-8; other loops are located in left turn only lanes-such as lanes 15-9, 15-10. Other conventional loops 17*i* are also installed in lanes leading to the intersection. Loops 17*i* are connected to other vehicle detectors which are configured to detect motorized vehicles only. It is understood that the intersection depicted in FIG. 1 is by way of example only, and that other intersections having different lane configurations are contemplated. What is essential is the inclusion of at least one vehicle detector loop in any lane having a corresponding control head.

In any given lane at any given time, a motorized vehicle or a bicycle may pass over the vehicle detector loops 14*i* in that lane. Each such vehicle and bicycle is detected by the corresponding vehicle detector for that lane so that the appropriate control signals can be furnished to the intersection traffic controller 12.

Figure 2:
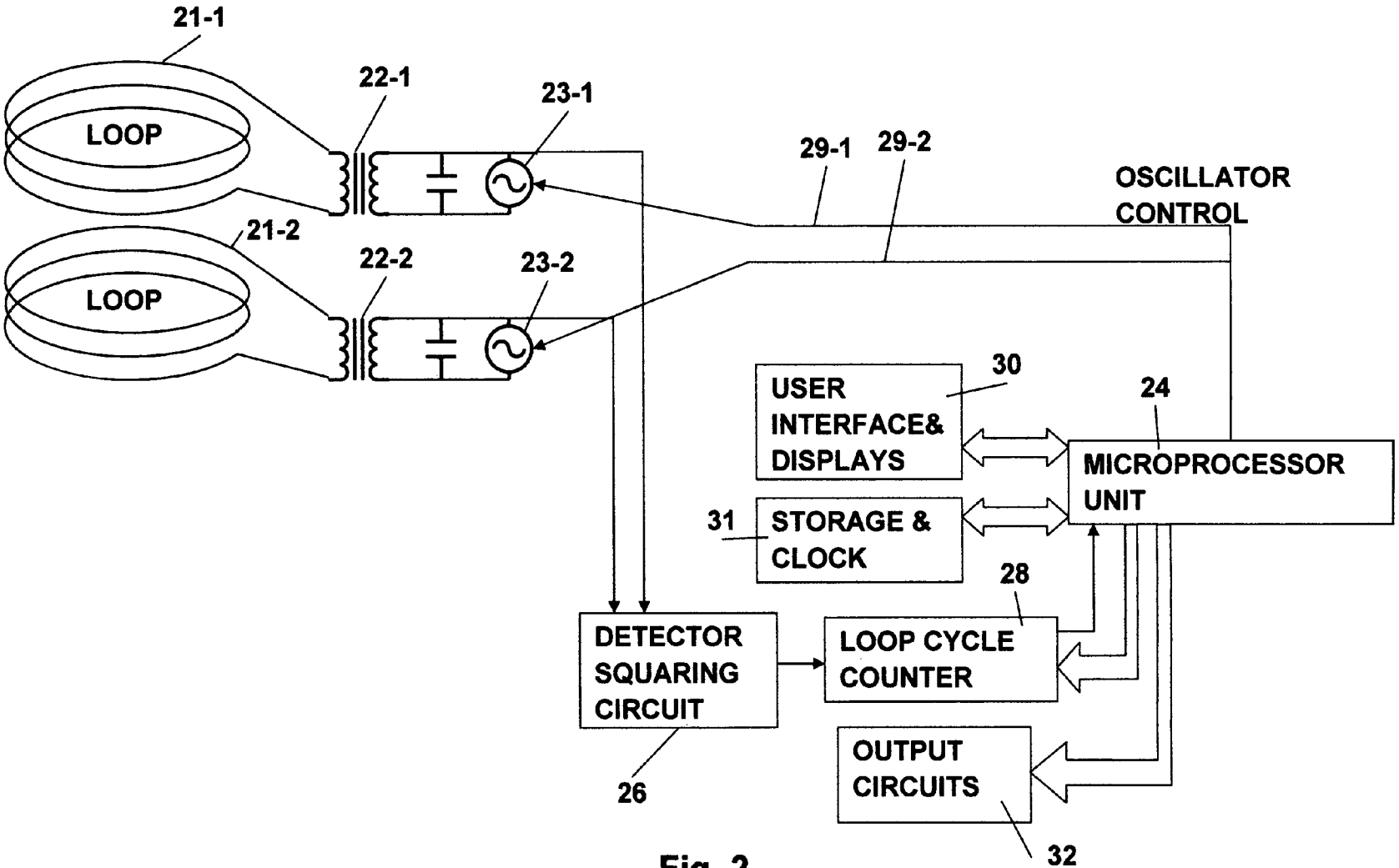
FIG. 2 is a block diagram of an embodiment of a vehicle detector with bicycle detection capability.
Figure 3:
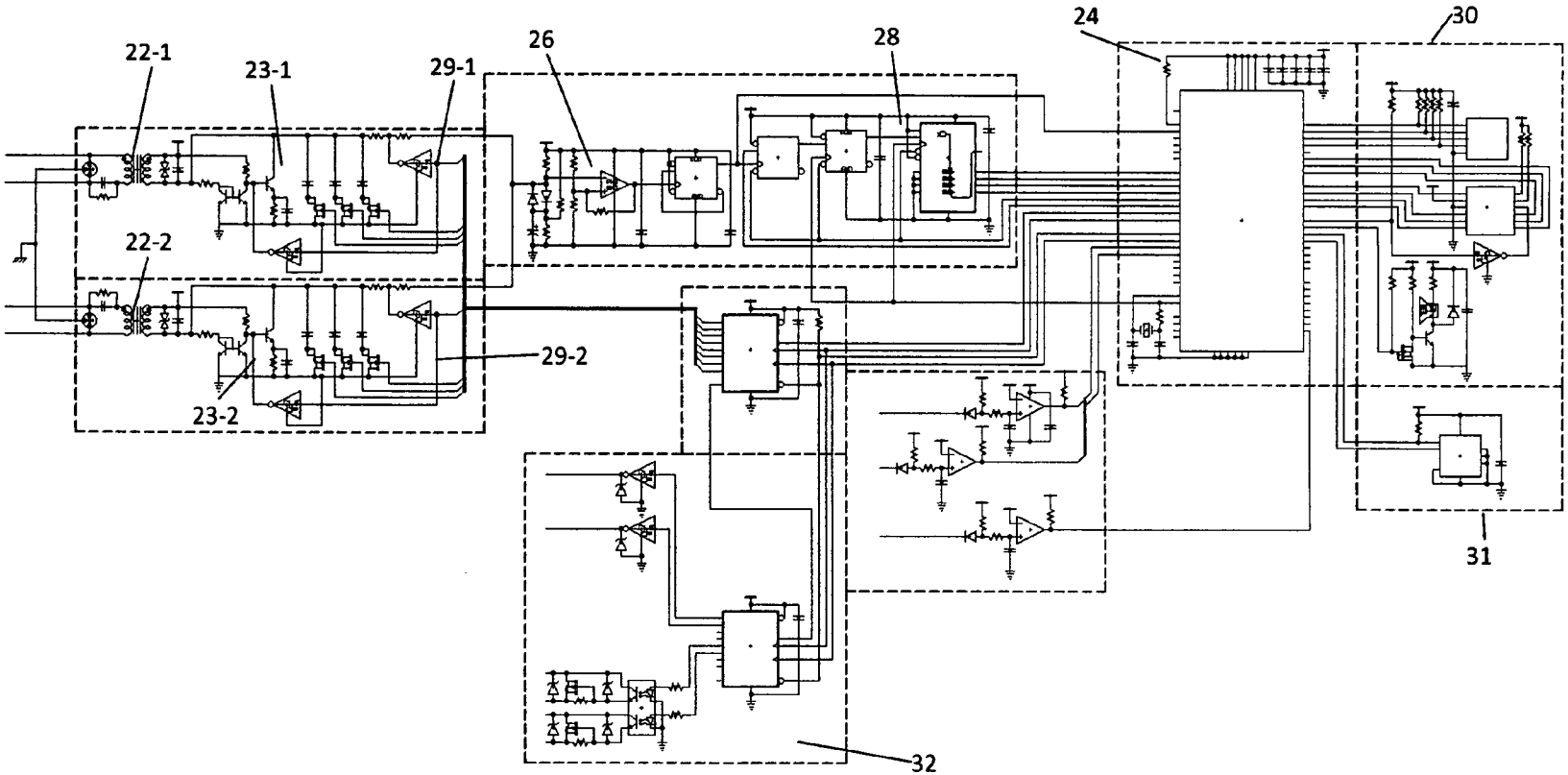
FIG. 3 is a circuit diagram of the specific embodiment of the vehicle detector illustrated in block diagram form in FIG. 2.

FIG. 2 is a block diagram of a preferred embodiment of a two channel vehicle detector having bicycle detection capability incorporating the invention, while FIG. 3 is a circuit diagram of the specific embodiment of the vehicle detector illustrated in block diagram form in FIG. 2. While FIGS. 2 and 3 illustrate only two channels, it is understood that the number of channels may be greater than two, or the vehicle detector may be a single channel detector. Consequently, where appropriate the elements described below are referenced with the designation "i", where "i" is an integer. As seen in FIG. 2, each loop antenna 21*i* is coupled via an isolation transformer 22*i* to an oscillator 23*i* having a plurality of capacitors (only one illustrated in FIG. 2-*multiple* capacitors illustrated in FIG. 3) for setting the nominal frequency of the oscillator 23*i*. As seen in FIG. 3, in the preferred embodiment three of the capacitors are selectable by means of FET switches under control of a microprocessor 24. Microprocessor 24 is preferably a type 17C756A unit available from Microchip Technology, Inc of Chandler, Ariz. USA. The operational state of each oscillator 23*i* is controlled by a control signal generated by microprocessor unit 24 on a dedicated control line 29*i*: when at a first voltage level the control signal present on control line 29*i* turns on the corresponding oscillator 23*i*; when at a second voltage level the control signal present on dedicated control line 29*i* turns off the corresponding oscillator 23*i*. The frequency of each oscillator 23*i* is dependent in part upon the inductance presented thereto, which is dependent in part upon the presence or absence of a motorized vehicle or bicycle in the vicinity of the corresponding loop antenna 21*i*. The output of each oscillator 23*i* is coupled to a detector signal squaring circuit 26, the output of which is coupled to the input of a loop cycle counter 28. Loop cycle counter 28 is implemented in microprocessor 24 using a portion of the computer program listed in the computer program appendix.

In operation in the vehicle detector mode, each oscillator 23*i*, which typically operates in the range from about 20 kHZ to about 100 kHZ, produces a periodic signal in the circuit containing the corresponding loop antenna 21*i*. A second oscillator implemented in microprocessor 24 operating at a much higher frequency generates a sample count signal over a fixed number of loop cycles which are counted by the loop cycle counter 28. The relatively high frequency count signal is typically used to increment a counter configured in microprocessor 24, which stores a number corresponding to the sample count at the end of the fixed number of loop cycles. This sample count is compared with a reference count stored in another counter configured in microprocessor 24 and representative of a previous count in order to determine whether a motorized vehicle or a bicycle has entered or departed the region of the corresponding loop 21*i* in the time period between the previous sample count and the present sample count.

The initial reference value is obtained from one or more initial sample counts and stored in a reference counter. Thereafter, successive sample counts are obtained on a periodic basis, and compared with the reference count. If the two values are essentially equal, the condition of the loop 11*i* remains unchanged, i.e., a motorized vehicle or bicycle has not entered or departed the corresponding loop 21*i*. However, if the two numbers differ by at least a threshold amount in a first direction (termed the Call direction), the condition of the corresponding loop 21*i* has changed and may signify that a motorized vehicle or bicycle has entered the corresponding loop 21*i*. More specifically, in a system in which the sample count has decreased and the sample count has a numerical value less than the reference count by at least a threshold magnitude, this change signifies that the period of the loop signal has decreased (since fewer counts were accumulated during the fixed number of loop cycles), which in turn indicates that the frequency of the loop signal has increased, usually due to the presence of a motorized vehicle or bicycle in or near the corresponding loop 21*i*. When these conditions exist, the vehicle detector generates a signal termed a Call signal indicating the presence of a motorized vehicle or a bicycle in the loop 21*i*, and this signal is coupled to the traffic controller 12 via the output circuits block 32.

Correspondingly, if the difference between a sample count and the reference count is less than a second threshold amount, this condition indicates that a motorized vehicle or bicycle which was formerly located in or near the loop 21*i* has departed the detection zone. When this condition occurs, a previously generated Call signal is dropped.

Figure 4A:
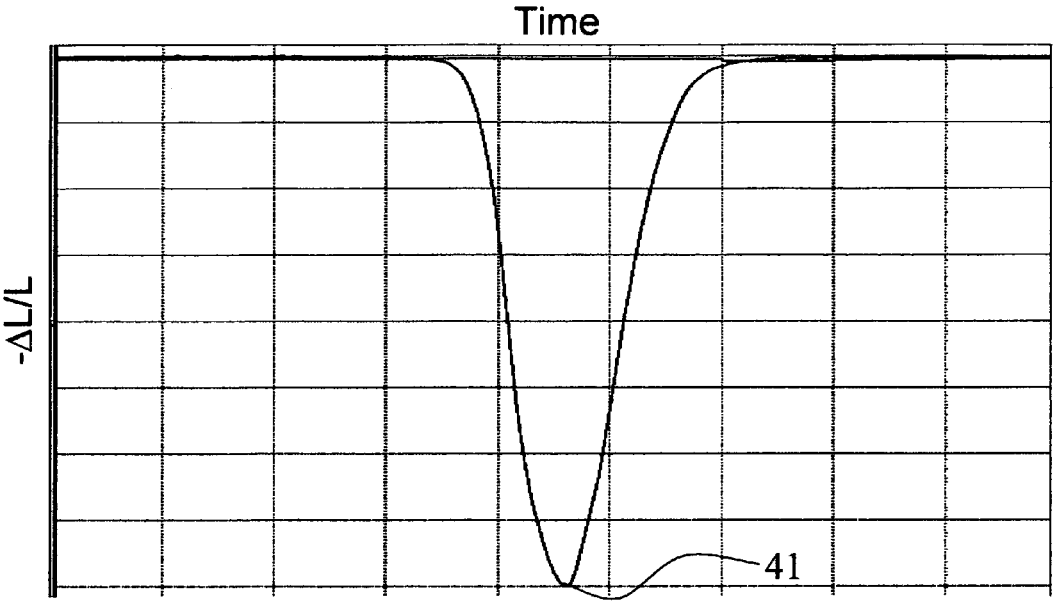
FIGS. 4A and 4B are graphs illustrating the signatures of a motorized vehicle (FIG. 4A) and a bicycle (FIG. 4B) passing over a vehicle detector loop.
Figure 4B:
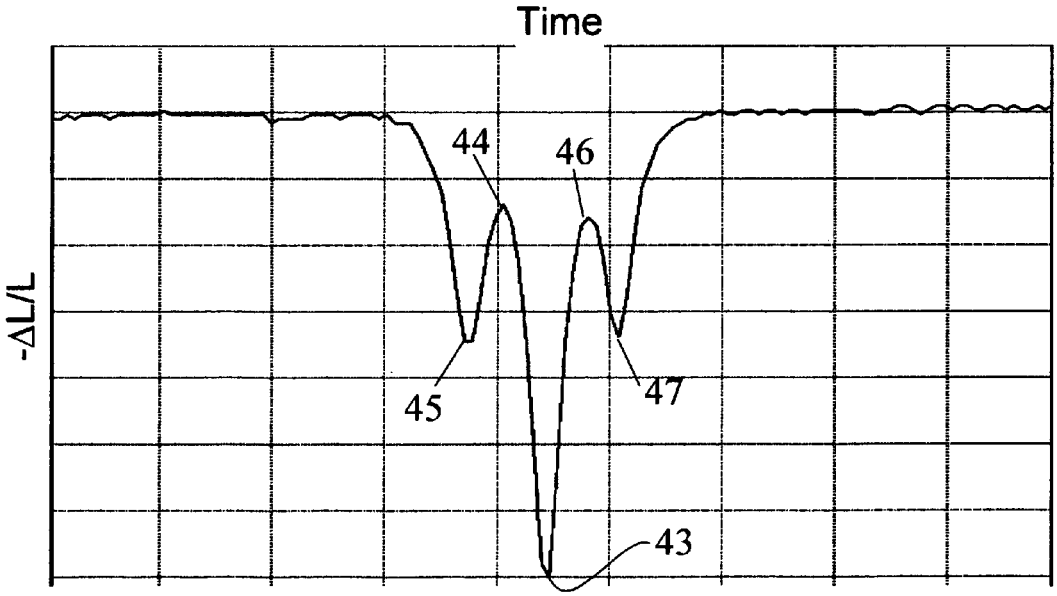

Bicycle detection is provided according to the invention using a specific signature analysis technique performed using, the $-\Delta L/L$ values obtained during the vehicle detection process. This is illustrated in FIGS. 4A and 4B. FIG. 4A is a plot of the measured values of $-\Delta L/L$ (Y-axis) over a period of time (X-axis) for a motorized vehicle passing over a loop 22*i*. As is evident from this Fig., the plot is nearly symmetric with a single central lobe 41. FIG. 4B is a plot of the measured values of $-\Delta L/L$ over a period of time for a standard bicycle passing over the same loop 22*i*. As is evident from this Fig., the plot has a central large lobe 43 flanked by two smaller lobes 45, 47. For purposes of this application, lobes 43, 45, 47 are termed "peaks". Thus, lobe 45 is "peak 1", lobe 43 is "peak 2", and lobe 47 is "peak 3". Between peaks 45 and 43 is a first inflection point 44. Similarly, between peaks 43 and 47 is a second inflection point 46. For purposes of this application, inflection points 44 and 46 are termed "valleys". Thus, inflection point 44 is "valley 1", while inflection point 46 is "valley 2". The FIG. 4A plot is the signature of a motorized vehicle; while the FIG. 4B plot is the signature of a bicycle. The difference in shapes between the two signatures provides sufficient information to distinguish between a motorized vehicle and a bicycle.

The signatures shown in FIGS. 4A and 4B were obtained using a parallelogram loop having the following geometry. The two shorter sides of the parallelogram loop are each forty-two inches long and each shorter side was located on the respectively adjacent lane line. The parallelogram long loop sides were arranged at a forty-five degree angle with respect to the direction of travel along the lane. The spacing between the long loop sides matches the spacing between the front and rear wheels of a standard bicycle. This accounts for the general shape of the signature shown in FIG. 4B. First peak 45 occurs when the front wheel of the bicycle is registered over the first-encountered long loop side. First valley 44 occurs when the front wheel of the bicycle is centered within the loop and neither wheel is registered over either long loop side. Second peak 43 occurs when the front wheel of the bicycle is registered over the last-encountered long loop side and the rear wheel of the bicycle is registered over the first-encountered long loop side. Second valley 46 occurs when the front wheel of the bicycle has left the interior of the loop and the rear wheel of the bicycle is within the loop interior. Third peak 47 occurs when the rear wheel of the bicycle is registered over the last-encountered long loop side. The following discussion only applies to loops having these geometrical characteristics or loops having different geometry but capable of producing signatures of the types illustrated in FIGS. 4A and 4B.

More particularly, a bicycle which passes over a loop and produces a signature like that illustrated in FIG. 4B is detected and discriminated from a motorized vehicle which passes over the same loop by applying a first set of four rules to the samples N collected and tested for compliance with the first set if four rules within a time period established by a timer termed a bicycle timer. In the preferred embodiment, this time period is selected to be 2.5 seconds. The purpose of the time period is to eliminate a false bicycle detection which might be caused by motorized vehicles moving in adjacent lanes, which can influence the value of the sample counts N collected over the sample periods and thus the signature produced by the loop. This first set of four rules is designed to detect the occurrence of a first peak 45, a first valley 44, a second peak 43 and a second valley 46 in the signature.

In describing the four rules, the following definitions apply:

N=Current Measured Loop Sample Counts

DR=Dynamic Reference Counts. (based on N reaching a Steady State). Steady State is N≤10 counts over a preselected time period (2-3 seconds).

SR=Static Reference Counts. Loop Reference Counts for the Channel (approximately 400,000). The actual reference count number is a function of the integral number of loop cycles and clock frequency PF=First Peak Counts (the difference between the reference and the sample counts N at the first peak).

PS=Second Peak Counts (the difference between the reference and the sample counts N at the second peak).

PN=Saved Counts (a number that defines Dynamic Reference Counts).

ΔM=[DR−N]

ΔN=[SR−N]

ΔT=either ΔN or ΔM depending on whether Static Reference Counts or Dynamic Reference Counts are being used for the calculation.

TL=Largest ΔT since last peak detection

TS=Smallest ΔT since last valley detection

VD=Valley Depth Counts.

BT=Bicycle timer value

A peak is detected when the current ΔT value is smaller than TL by 16 counts.

A valley is detected when the current ΔT value is larger than TS by 16 counts.

The four rules are:

Rule 1 (used to detect a first valid peak 45):

$$K1 \leq \text{peak } 1 \leq K2$$

where K1 is a constant lying in the range from 30-50 (preferably 40);

K2 is a constant lying in the range from 280-320 (preferably 300); and peak 1 is the ΔT value at peak 1.

Rule 2 (used to detect a first valid valley 44):

$$K3 \leq \text{valley } 1 \leq 0.625 \times \text{peak } 1$$

where K3 is a constant lying in the range from 10-20 (preferably 12);

valley 1 is the ΔT value at valley 1; and peak 1 is the ΔT value at peak 1.

Rule 3 (used to detect a second valid peak 43):

$$1.125 \times \text{peak } 1 \leq \text{peak } 2 \leq K4$$

where peak 1 is the ΔT value at peak 1; peak 2 is the ΔT value at peak 2; and K4 is a constant lying in the range from 360-440 (preferably 400).

Rule 4 (used to detect a second valid valley 46):

$$K5 \leq \text{valley } 2 \leq \text{peak } 2 - [0.375 \times \text{peak } 1]$$

where K5 is a constant lying in the range from 10-20 (preferably 12);

valley 2 is the ΔT value at valley 2; peak 2 is the ΔT value at peak 2; and peak 1 is the ΔT value at peak 1.

The signature analysis process starts when a loop disturbance is detected. During the signature analysis process, a running total of the number of peaks detected is accumulated in a peak counter. Similarly, a running total of the number of valleys detected is accumulated in a valley counter. In addition, the temporal length of the signature analysis process is measured by the bicycle timer noted above, which is started when the first peak is detected. The first set of rules must be satisfied within the bicycle timer period (2.5 seconds in the preferred embodiment): otherwise, the signature analysis process is re-started. All counters and timers are implemented in microprocessor unit 24 by the above-referenced computer program.

During the signature analysis process the progress of the analysis is monitored by the use of several flag registers configured in microprocessor unit 24 by the above-referenced computer program. The specific flags are as follows:

"Loop Disturbance" flag—This flag is set when ΔN≥15. This flag is cleared when ΔN<15.

"Motorized Vehicle" flag—This flag is set when ΔN≥125. This flag is cleared when there is an output for the vehicle.

"Motorcycle" flag—This flag is set when a possible motorcycle has entered the loop. This flag is cleared when it is determined that the vehicle is not a motorcycle (ΔN>700), or the motorcycle detection has been processed.

"First Peak Bike" flag—This flag is set when Peak Counter=1 and the rule for first peak is satisfied. This flag is cleared when "Loop Disturbance" flag is cleared.

"Second Peak Bike" flag—This flag is set when Peak Counter=2 and the rule for the second peak is satisfied. This flag is cleared when "Loop Disturbance" flag is cleared "Steady State" flag—This flag is set when "Loop Disturbance" flag is set, and successive ΔNs are within 10 counts of each other for 2 seconds. This flag is cleared when "Loop Disturbance" flag is cleared, or when Peak Counter is cleared after Peak Counter>3.

"Steady State 2" flag—This flag is set when "Loop Disturbance" flag is set, and successive ΔNs are within 10 counts of each other for 2 seconds. This flag is cleared when "Loop Disturbance" flag is cleared.

"Valley Depth Deep" flag—This flag is set when Valley Counter=1, and the rule for first valley is satisfied. This flag is cleared when "Loop Disturbance" flag is cleared.

"Has Bike" flag—This flag is set when the rules for bicycle detection are satisfied. This flag is cleared when "Loop Disturbance" flag is cleared.

Figure 4C:
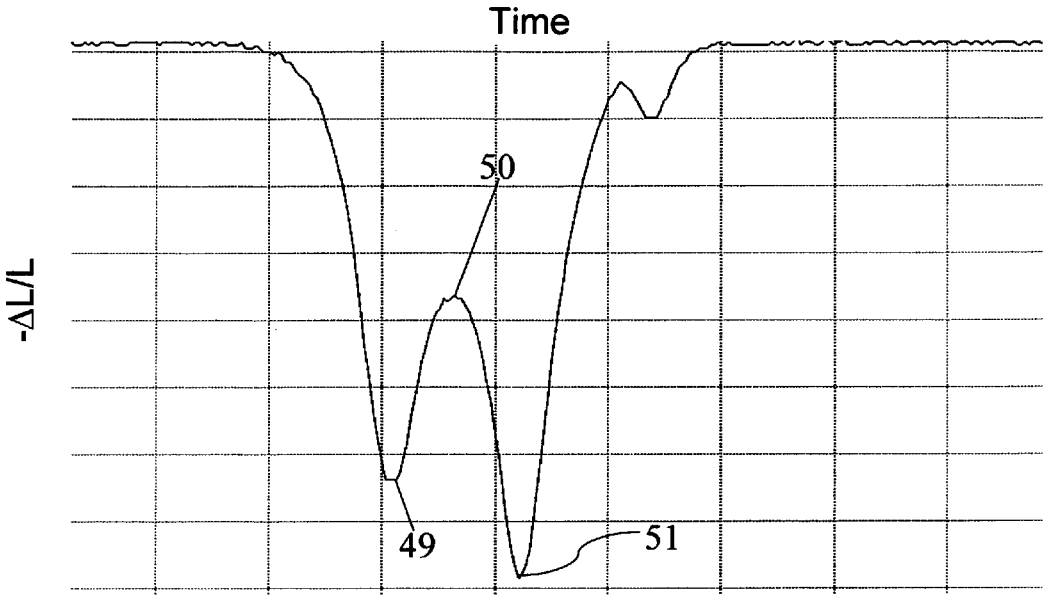
FIGS. 4C and 4D are graphs illustrating the signatures of a bicycle passing over a vehicle detector loop near the right and left edges of the loop respectively.
Figure 4D:
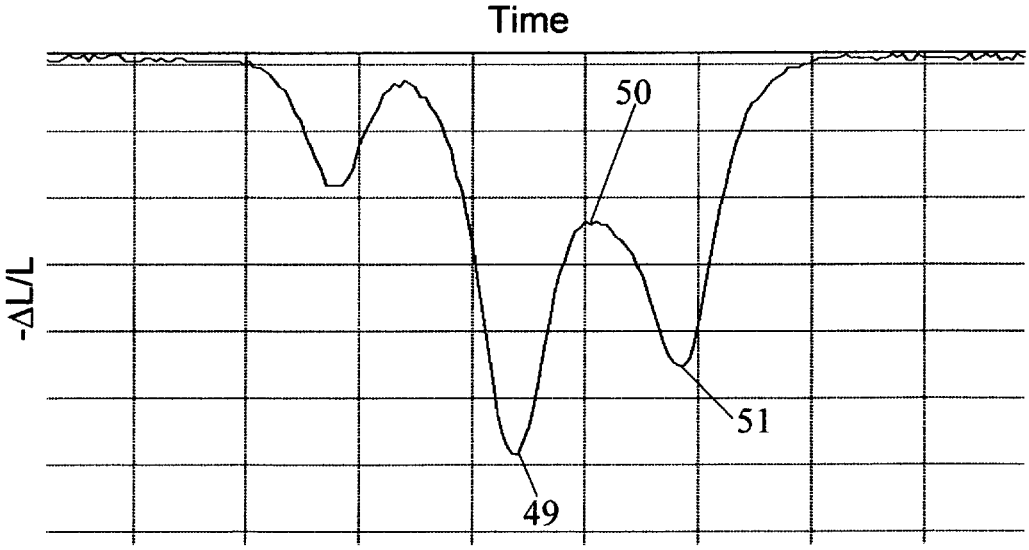

While the above-described first set of rules reliably detects a bicycle passing over a parallelogram loop to produce the signature illustrated in FIG. 4B and discriminates a bicycle from a motorized vehicle in the manner described above, it has been empirically determined that some bicyclists prefer to ride along the edge of a lane line rather than well within a lane. This alters the nature of the signature obtained. More specifically, FIGS. 4C and 4D illustrate the shape of the signatures obtained when a bicycle passes through a parallelogram loop one foot from the right edge of the loop (FIG. 4C) and one foot from the left edge of the loop (FIG. 4D). As can be seen from these Figs., the resulting signature does not contain the necessary two peaks and two valleys required to satisfy the first set of rules. In both FIGS. 4C and 4D there are two detectable peaks 49, 51 but only one detectable valley 50. As a consequence, and in order to allow detection of a bicycle maneuvered through the loop in such a way as to produce the signatures shown in FIGS. 4C and 4D, provision is made to modify the tests applied under the above-described first set of rules and a second set of four rules is provided which can be applied to the samples N collected and tested for compliance with the second set of four rules within a time period established by the bicycle timer. In the preferred embodiment, this time period is selected to be 2.5 seconds for this second set of rules. The purpose of the time period is to eliminate a false detection which might be caused by motorized vehicles moving in adjacent lanes, which can influence the value of the sample counts N collected over the sample periods. This second set of rules is designed to detect the occurrence of a first peak 49, a first valley 50, and a second peak 51 in the signature.

The above described definitions apply to this second set of rules, and peaks and valleys are detected in the same way as already described for the first set of rules. The same timers, counters and flags are also used with the second set of rules. However the rules for detecting a first valid peak 49, a first (and only) valid valley 50, and a second valid peak 51 are different.

Rule 1 (used to detect a first valid peak 49):

$$K6 \leq \text{peak } 1 \leq K7$$

where K6 is a constant lying in the range from 30-50 (preferably 40);

peak 1 is the ΔT value at peak 1; and K7 is a constant lying in the range from 380-420 (preferably 400).

Rule 2 (used to detect a valley 50):

$$\text{Valley} \geq 12$$

where Valley is the ΔT value at the valley

Rule 3 (used to detect the second valid peak 51):

$$K6 \leq \text{peak } 2 \leq K7$$

where K6, K7 are as defined above and peak 2 is the ΔT value at peak 2.

Once all three rules have been satisfied, the valley value is compared with the average value of the two peaks, i.e.

$$\text{Peak Average} = \frac{\text{peak } 1 + \text{peak } 2}{2}$$

Rule 4:

If Valley≤0.625 Peak Average, then a bicycle is present and the "Has Bike" flag is set.

Figure 5A:
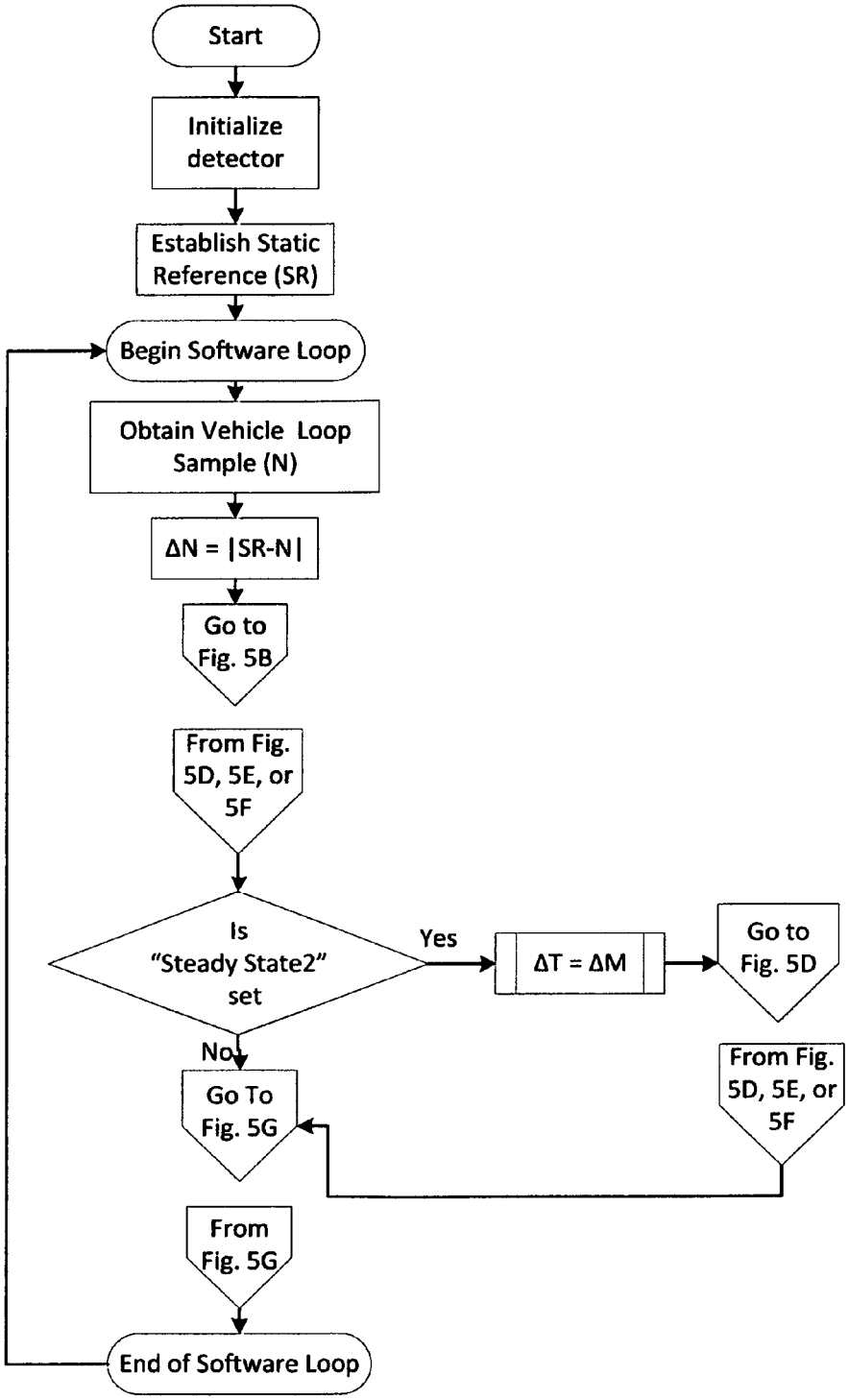
FIGS. 5A-5G together comprise a flow diagram illustrating the operation of the vehicle detector illustrated in block diagram form in FIG. 2 when configured to detect bicycles using the signature analysis technique according to the invention.
Figure 5B:
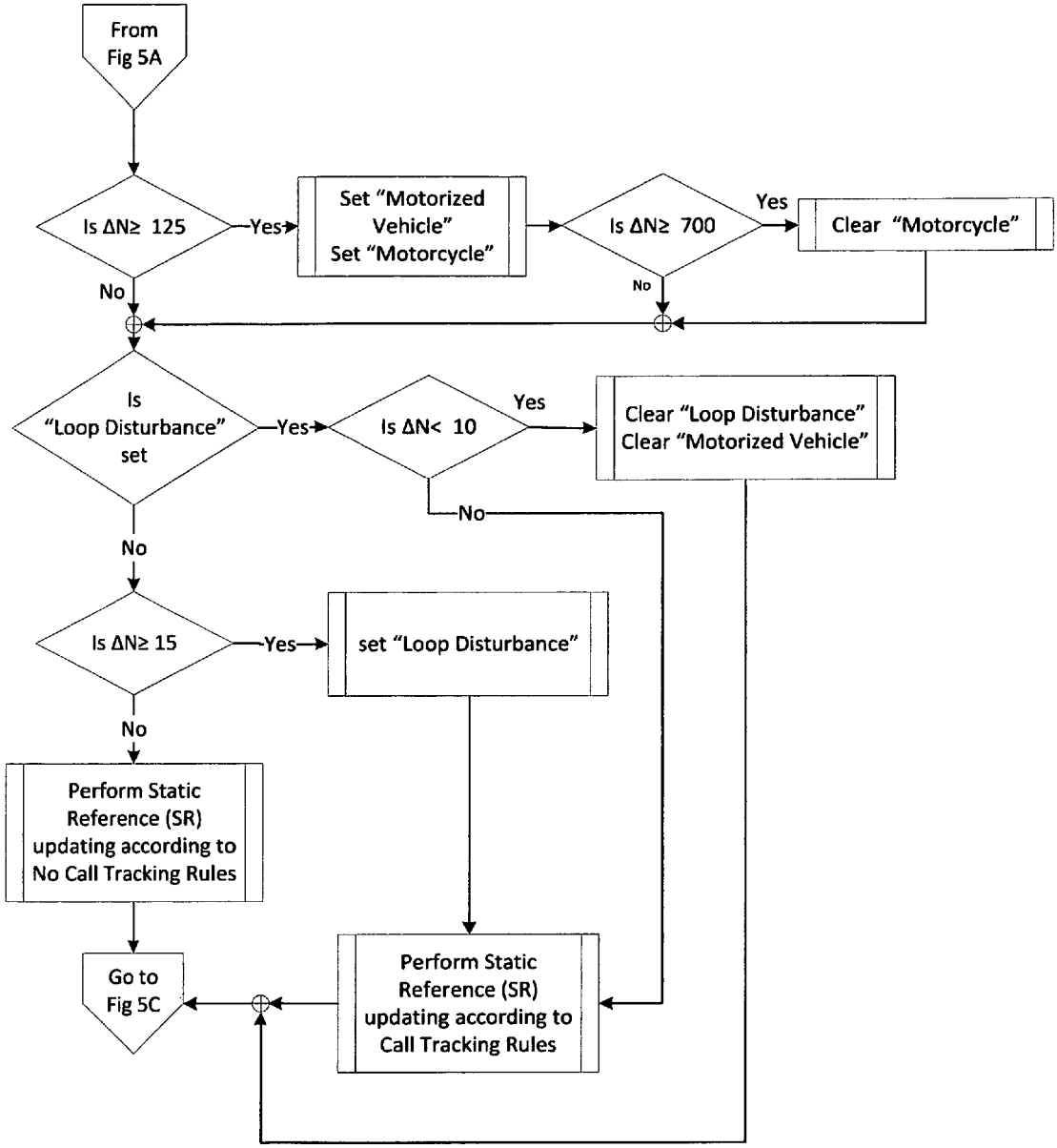
Figure 5C:
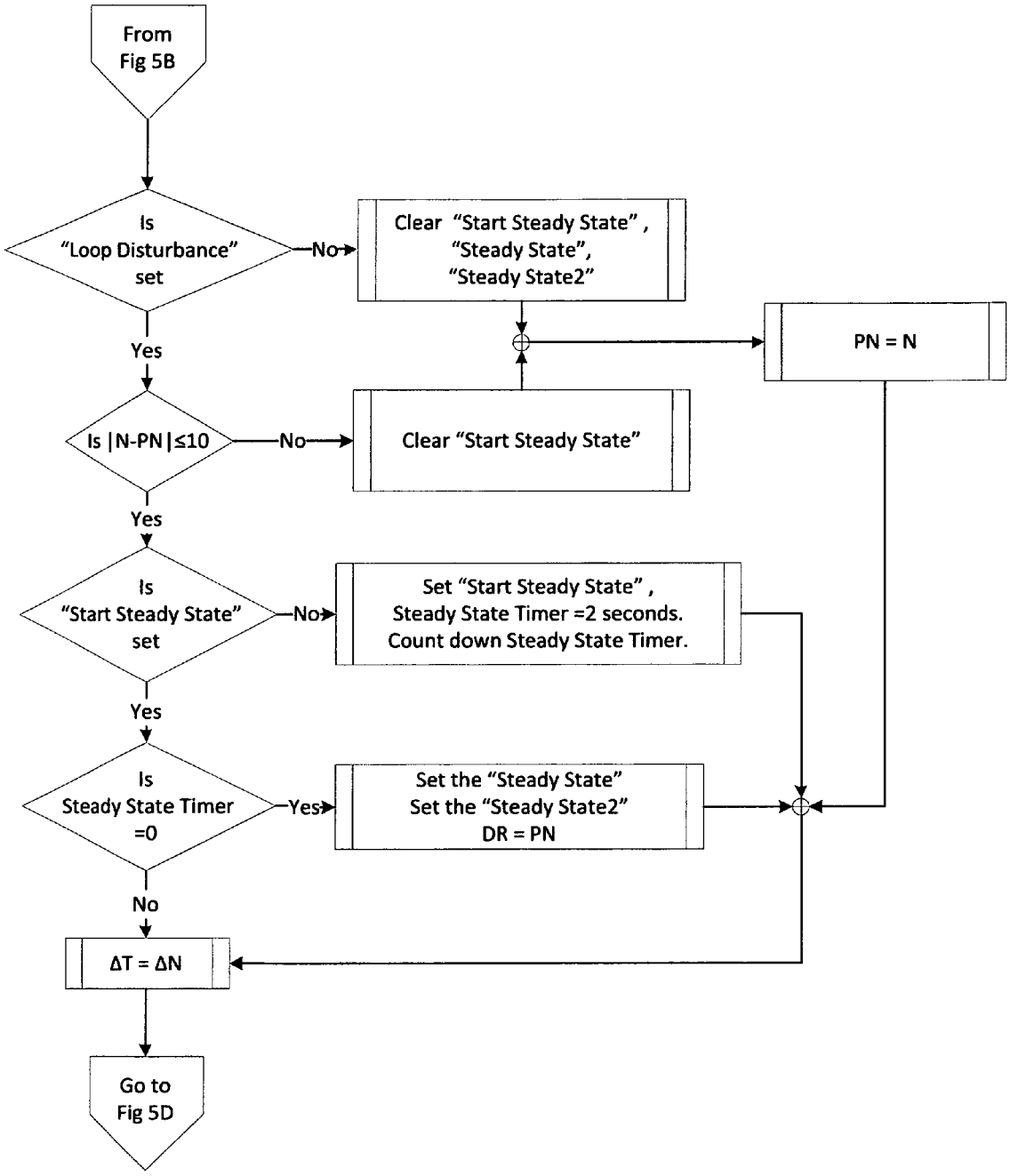
Figure 5D:
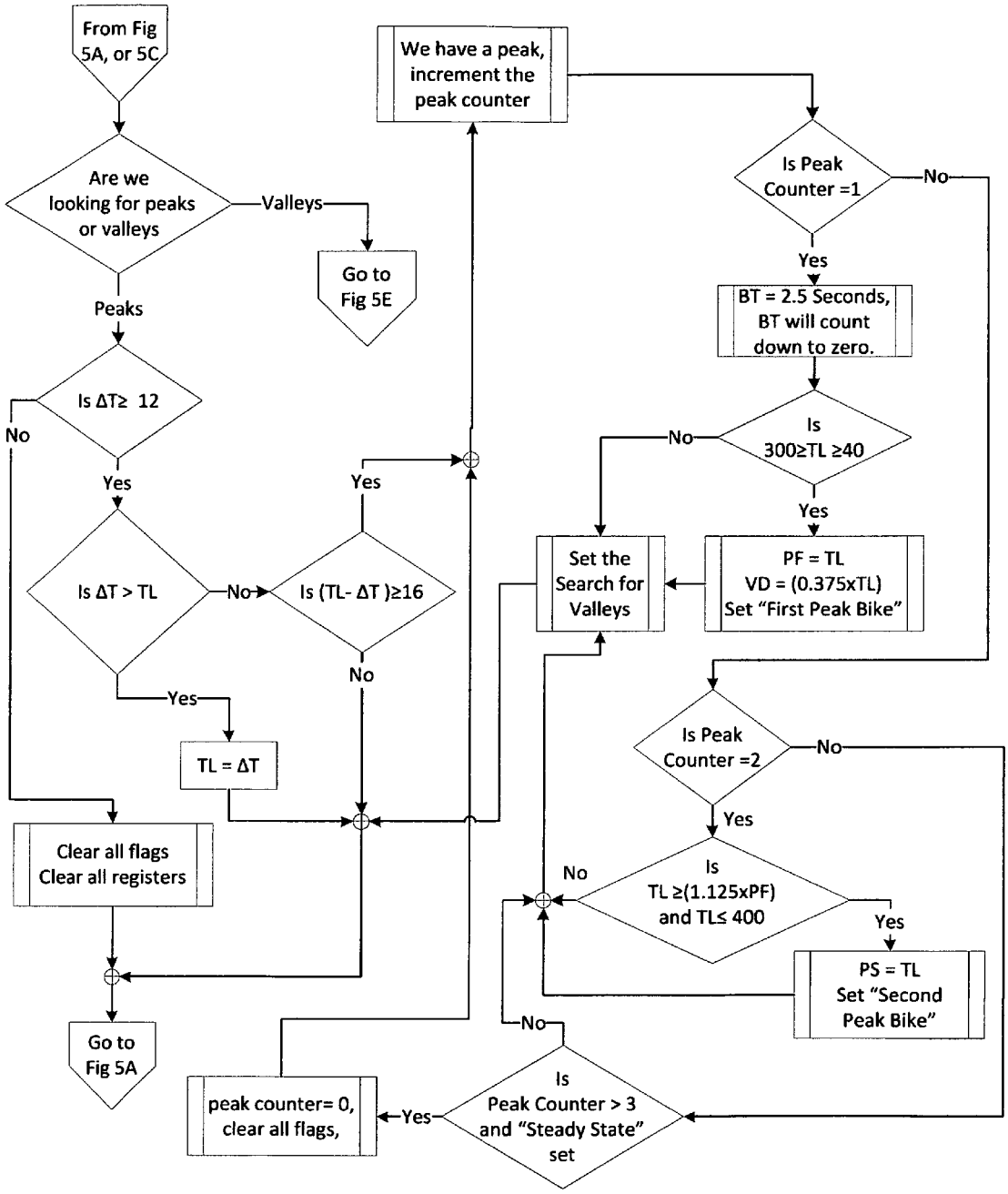
Figure 5E:
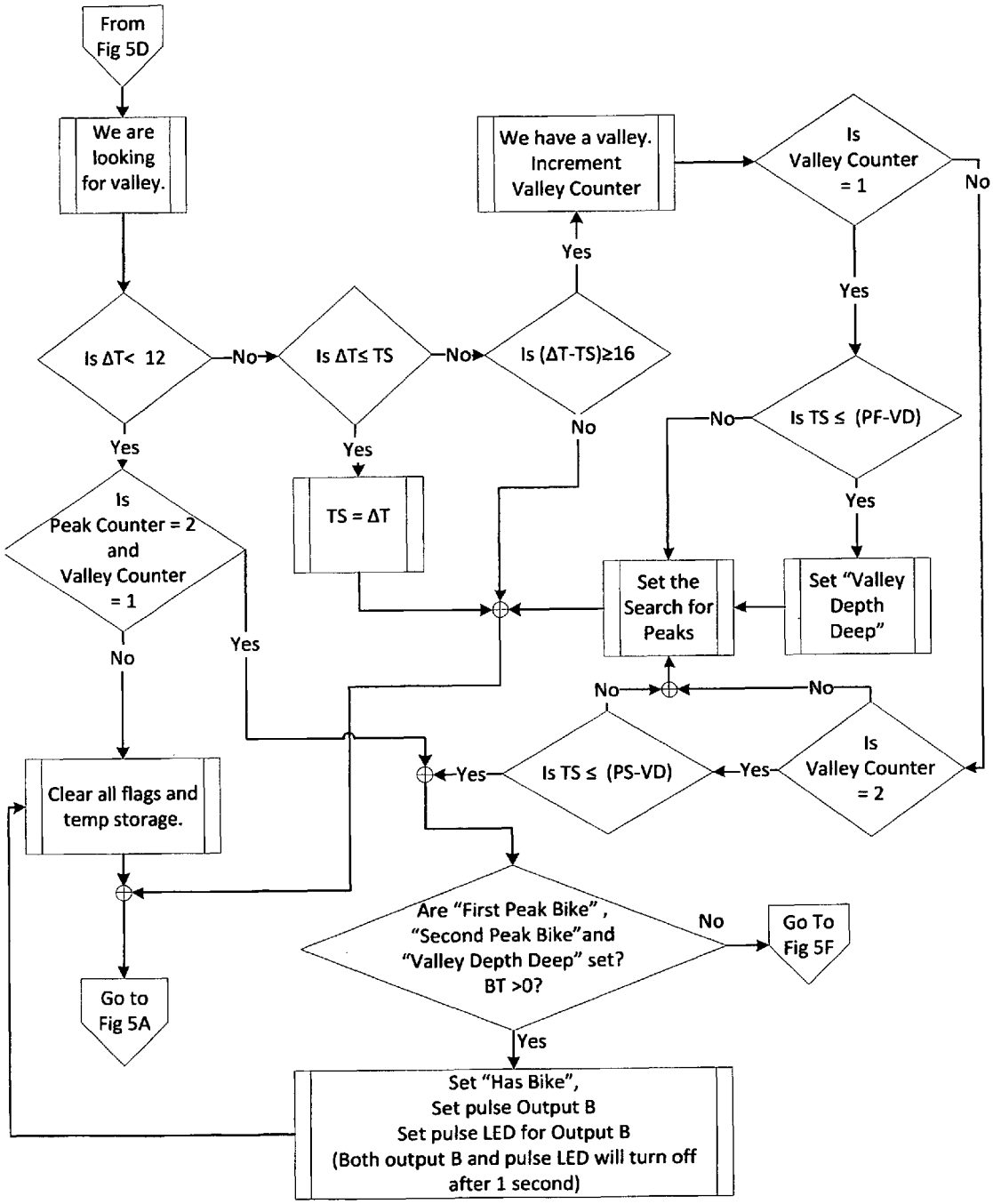
Figure 5F:
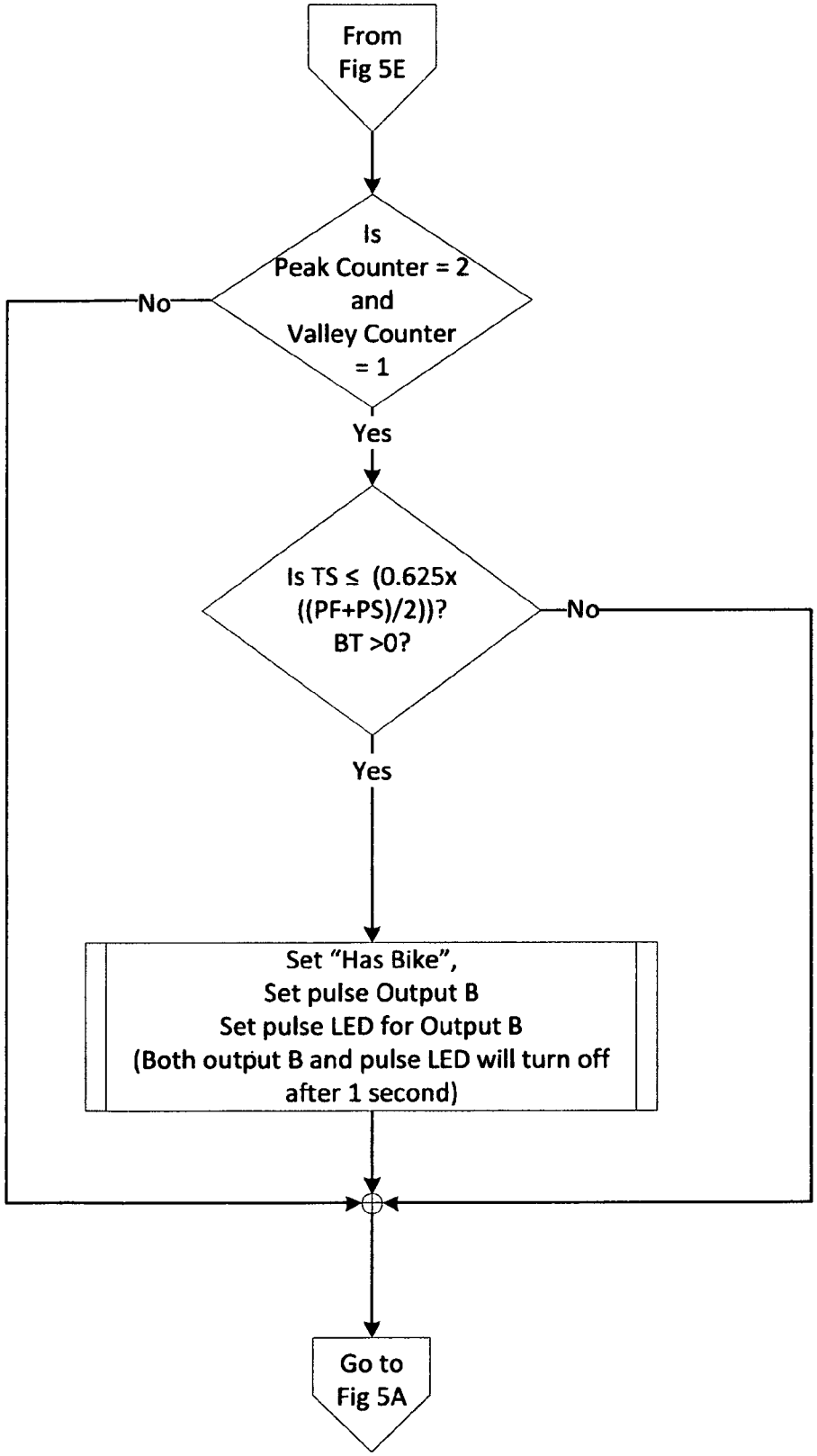

The sequential steps used in the signature analysis technique according to the invention are illustrated in the compound flow chart of FIGS. 5A-5G. These steps are performed by microprocessor unit 24 as configured by the above-referenced computer program. The peak search routine is illustrated in FIG. 5D, while the valley search routine is illustrated in FIG. 5E. On start up, once a loop disturbance occurs (loop disturbance flag is set) the system defaults to the peak search routine, after which the valley search routine is conducted, followed by another peak search routine, another valley search routine, etc. Each detected peak and valley is tested using the first set of rules. Whenever a second valley has been detected within the bicycle timer time period, it is immediately tested for validity using rule 4 of the first set of rules. If the second valley is a valid valley, the "Has Bike" flag is set and the vehicle detector outputs both a pulse output (output B below) and a presence output (output A below)—see FIGS. 5E and 5G. During the search for valleys, if the value of ΔT≤12 (taken to signify that the object causing the loop disturbance is no longer in the region of the loop) the valley search routine checks whether two valid peaks and one valid valley have been detected within the bicycle timer period (FIG. 5E—Are "First Peak Bike", "Second Peak Bike" and "Valley Depth Deep" set and BT>0). If so, the "Has Bike" flag is set and the vehicle detector outputs both a pulse output (output B below) and a presence output (output A below). If not, rule 4 of the second set of rules is applied (FIG. 5F) and a check of the bicycle timer is made to determine whether the routine is still within the bicycle timer time period. If so, the "Has Bike" flag is set and the vehicle detector outputs both a pulse output (output B below) and a presence output (output A below)—see FIGS. 5F and 5G.

Figure 5G:
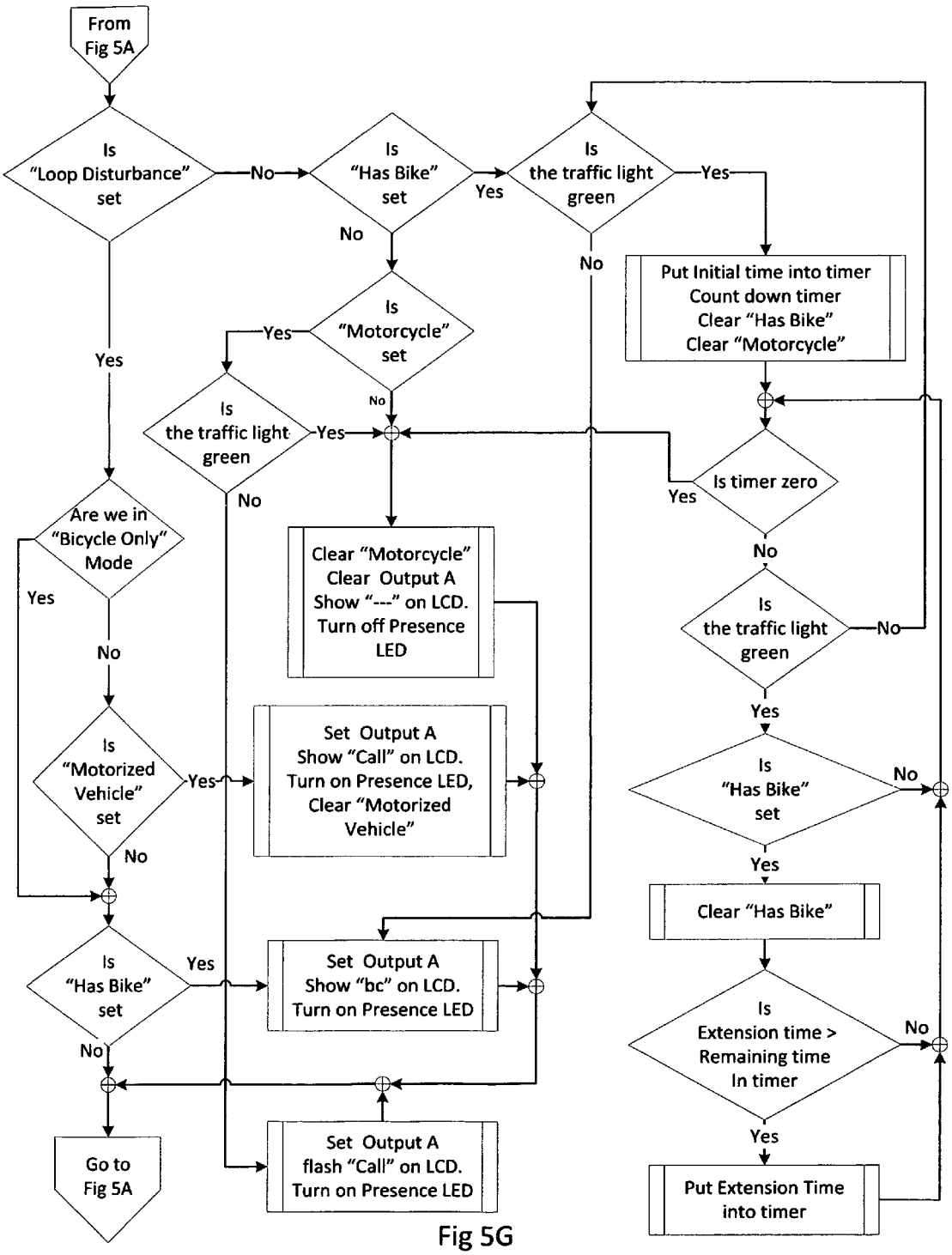

Once a bicycle has been detected by either the first set of rules or the second set of rules-an event which is signified by "Has Bike" flag set-the vehicle detector is configured to provide initial bicycle clearance timing to enable the bicycle to safely clear the intersection and to provide additional bicycle extension timing for any subsequent bicycles (FIG. 5G). Initially, the vehicle detector checks the phase green input from the traffic controller to determine whether the traffic light is in the phase green state. If so, the bicycle initial time is set into a timer and the timer begins to count down (see FIG. 5G). If the timer counts down to zero before another bicycle is detected, the routine returns to "Begin Software Loop" (FIG. 5A). If another bicycle is detected before the timer counts down to zero (signified by "traffic light green" and "Has Bike" flag set-FIG. 5G), the value of the extension time is compared to the remaining initial time in the timer. If the value of the extension time is greater than the remaining initial time, the extension time value is set into the timer. If not, the timer continues to count down to zero.

During installation of a vehicle detector incorporating the invention at an intersection such as that depicted in FIG. 1, the installation technician will normally perform an initial set up using push switches and displays incorporated into element 30 of the vehicle detector (FIG. 2). Element 30 is described in detail in the above-referenced '964 U.S. Patent and includes push button switches, and an LCD display having seven segment characters, a bar graph, and special symbols. The purpose of the initial set up is to tailor the operation of the vehicle detector to the particular requirements of a given intersection, such as the particular vehicular lanes for which bicycle detection is necessary or desirable, the vehicular lanes for which bicycle detection is not needed (if any), the duration of the bicycle clearance time deemed desirable for a given lane at the intersection, and other vehicle control parameters.

The vehicle detector is designed to detect all vehicles with the added ability of differentiating bicycles from all other motorized vehicles, including motorcycles. Separating bicycles from motorized vehicles allows programming independent initial and extension times for bicycles using the switches in element 30. Thus the installation technician can individually select the bicycle initial time and the bicycle extension time. In the preferred embodiment, the bicycle initial time can be changed in one second steps, while the bicycle extension time can be changed in 0.1 second steps. This allows the traffic engineer to detect and provide safe passage time for bicycles without compromising the intersection's operating efficiency. In order to function properly, the associated phase green logic must be connected to the phase green input of the vehicle detector.

When a bicycle is detected passing through the bicycle loop while the associated phase is not green, the detector output is latched in the CALL state. The latched CALL insures the traffic controller will provide a green signal for bicycles. This method of operation insures that, regardless of where the bicycle stops, the bicycle receives a green signal with the proper initial timing.

When the associated phase green becomes active, the bicycle initial time begins timing. When the bicycle initial time reaches zero, the latched CALL is cleared. This method of clearing the latched CALL insures that bicycles always receive a full bicycle initial time, even if the normal phase green is interrupted prematurely (e.g., if a pre-emption occurs that terminates the green phase prior to a full bicycle initial time, the bicycle receives a full bicycle initial time on the following cycle of the traffic controller).

When a bicycle is detected passing through the bicycle loop while the associated phase is green, the CALL is not latched in the CALL state. However, each bicycle passing through the bicycle loop during phase green extends the CALL by the programmed bicycle extension time. When the extension time is set to zero the extension time defaults to the bicycle initial time value. If additional bicycles are detected before the initial time reaches zero each subsequent bicycle extends the call by either the remaining amount of initial time or the extension time, whichever is greater. Thus, when the extension time is set to any value other than zero the detector provides the initial time plus a separate extension time for any subsequent bicycles during phase green. The detector's latched call, initial time, and extension time respond only to bicycles. For all other vehicles the detector functions as a standard presence detector without timing.

The vehicle detector provides two outputs per channel-Output A and Output B. The primary output A provides CALL outputs for all vehicles (i.e., all motorized vehicles, including motorcycles, and bicycles). The primary output A can be programmed to provide CALL outputs for bicycles only. The secondary output B provides a single pulse for each bicycle.

The detector can also be set for Bicycle Detect Only Mode. In the Bicycle Detect Only Mode the detector outputs call signals only for bicycles; the detector does not output call signals for other vehicles passing over the bicycle detection loop.

Bicycle Loop Geometry Recommendations

The optimum bicycle loop geometry is a four-turn parallelogram. The two shorter sides of the parallelogram loop are each forty-two inches long and each shorter side should be on the respectively adjacent lane line. The parallelogram long loop sides are arranged at a forty-five degree angle with respect to the direction of travel along the lane. The spacing between the long loop sides matches the approximate spacing between the front and rear wheels of a standard bicycle.

Recommended Loops

The PLB Preformed Loop or PLH Preformed Loop available from Reno A&E, Reno, Nev. can be configured as a 42 inch parallelogram bicycle loop. The PLB Preformed Loop is constructed using 0.23" XLPE cable and is designed for installation in a ¼ inch saw cut. The design provides for adjustment of the loop cable to adapt to small variations in the perimeter of the saw cut. There is no need for 45 degree corner cuts. Remove sharp inside corners of the saw cut with a small chisel to protect the loop cable from damage. The lead-in cable is 0.23" OD and can be supplied in any length necessary to provide a continuous run to the traffic cabinet without the need for splicing a separate lead-in cable.

The PLH Preformed Loop is constructed using 0.375" XLPE cable and is designed to be overlaid with asphalt, embedded in concrete, or installed in a saw cut in the manner of conventional loops.

Accurate bicycle detection and discrimination requires the ability for the vehicle detector to respond to extremely small changes in the inductive loop's electrical field. This requirement dictates that both the inductive loop and the electronic processing circuits are capable of operating in a stable manner.

Traditionally, Inductive loops have been installed in the pavement by saw cutting the pavement, wrapping a single conductor of insulated electrical wire in the saw cut slot, and filling the slot with a sealer such as crack sealant. The harsh environment of the pavement coupled with inferior insulation has been the source of loop failures for many years. As detection performance requirements have increased, problems with operational stability and reliability have also increased. One problem in operational stability results from movement of adjacent wires in the saw slot, which causes small changes in the value of the electrical field. A second problem results from water entering the slot, changing the electrical characteristics, which causes small changes in the electrical field. Small changes in the electrical field caused by the presence of a bicycle cannot be reliably distinguished from small changes in the electrical field caused by environmental changes.

The use of high quality pre-formed loops eliminates these problems and significantly improves reliability and performance. High quality pre-formed loops are fabricated using a multi-conductor cable constructed with XLPE (cross linked polyethylene) insulation. XLPE insulation withstands temperatures of over 400 degrees Fahrenheit providing excellent resistance to damage from pavement movement. Another advantage is provided by the incorporation of a water block material under the outer jacket encapsulating the wires, thus eliminating the possibility of water migrating between the wires. An additional benefit is afforded by the use of the use of a single multi-conductor cable which also adds strength by bundling all the separate wires into a single cable. Over the past ten years high quality pre-formed loops have eliminated loop failures.

As will now be apparent, vehicle detectors incorporating the invention provide a bicycle detect and discrimination capability based on signature analysis as well as a motorized vehicle detection capability. The signature analysis technique, when combined with a loop having a geometry capable of producing signatures of the types shown in FIGS. 4A-4D, provides bicycle detection and discrimination between bicycles and motorized vehicles with a reliability approaching 100%. In addition, the use of the two sets of rules enables the reliable detection of not only bicycles passing through the major area of the loop, but also bicycles passing over the loop closely adjacent the short edges. Consequently, the probability of a bicycle passing over the loop and not being detected is close to zero.

When a bicycle is detected, a different clearance time is provided which is of sufficient length to enable a bicycle to proceed safely through an intersection. The length of this bicycle clearance time can be selected by the technician at the intersection to match the physical configuration of the intersection. A given channel may be configured to operate in a bicycle only detect mode so that only bicycles will be detected by that channel. This mode is useful in installations where it is desirable to count the number of bicycles in a given lane where both bicycles and motorized vehicles are permitted. It is also useful in counting the number of bicycles in a bicycle only lane. When operating in either the bicycle detect or bicycle only detect modes, the vehicle detector provides additional clearance time for successive bicycles which arrive at the loop(s) controlled by that vehicle detector, the additional clearance time being supplied by either an extension time selected by the operator or the remaining Initial time in the initial timer during count down, whichever time value is greater.

While the invention has been described with reference to a vehicle detector incorporating the functions of establishing the Initial Timer and Extension Time values and using these values to process the duration of the clearance interval and supply this control information to the associated traffic controller, some known traffic controllers are currently provided with the processing capability to perform these functions. In such applications, the vehicle detector can be modified to simply provide to the traffic controller a first output signal indicating that a motorized vehicle has been detected and a second output signal indicating that a bicycle has been detected. In response to the receipt of such signals, the traffic controller can then perform the necessary latching and timing functions for controlling the Phase Green indication.

While the above provides a full and complete disclosure of the preferred embodiments of the invention, various modifications, alternate constructions and equivalents will occur to those skilled in the art. For example, while the invention has been described with reference to a specific microprocessor, different types of microprocessor may be employed, as desired, along with compatible program routines to accomplish the same type of bicycle detect operations. In addition, while the preferred loop configuration has been described as a preformed loop with a parallelogram configuration having the dimensions and traffic lane placement as noted above, different loop geometries may be employed provided that the signatures produced conform to those shown in FIGS. 4A-4D and described in detail above. Therefore, the above should not be construed as limiting the invention, which is defined by the appended claims.

What is claimed is:

1. A vehicle detector with bicycle detect and discrimination capability using signature analysis, said vehicle detector comprising:

an oscillator adapted to be coupled to a loop; a memory; and a processor operatively coupled to said oscillator and said memory, said memory having machine readable code stored therein, said machine readable code configured to enable said processor to activate said oscillator to produce a signal for said loop, to implement a loop cycle counter for counting a predetermined number of loop oscillator cycles defining a sample period, to implement a sample counter for accumulating sample counts N during said predetermined number of loop oscillator cycles; to implement a reference counter for storing a reference count R based on the accumulated sample counts from a previous sample period; to implement an evaluation unit for determining from the sample counts N and the reference count R whether a vehicle has entered the loop during the sample period and for determining from the sample counts N and the reference count R whether a detected vehicle is a bicycle; and to implement a Call signal generator for generating a Call signal when the evaluation unit has determined that a vehicle has entered the loop during the sample period, said machine readable code being configured to enable said evaluation unit to determine whether a detected vehicle is a bicycle by successively detecting peaks and valleys in a signature formed by a collection of sample counts N and at least one reference count R, testing each detected peak and valley against a first set of rules, and generating a "Has Bike" signal when two peaks and two valleys satisfy said first set of rules.

2. The vehicle detector of claim 1 wherein said first set of rules comprises:

Rule 1 (used to detect a first valid peak):

$$K1 \leq \text{peak } 1 \leq K2$$

where K1 is a constant lying in the range from 30-50; K2 is a constant lying in the range from 280-320; and peak 1 is the (R−N) value at peak 1;

Rule 2 (used to detect a first valid valley):

$$K3 \leq \text{valley } 1 \leq 0.625 \times \text{peak } \mathbf{1}$$

where K3 is a constant lying in the range from 10-20; valley 1 is the (R−N) value at valley 1; and peak 1 is the (R−N) value at peak 1;

Rule 3 (used to detect a second valid peak):

$$1.125 \times \text{peak } 1 \leq \text{peak } 2 \leq K4$$

where peak 1 is the (R−S) value at peak 1; peak 2 is the (R−N) value at peak 2; and K4 is a constant lying in the range from 360-440;

Rule 4 (used to detect a second valid valley):

$$K5 \leq \text{valley } 2 \leq \text{peak } 2 \leq [0.375 \times \text{peak } 1]$$

where K5 is a constant lying in the range from 10-20; valley 2 is the (R−N) value at valley 2; peak 2 is the (R−N) value at peak 2; and peak 1 is the (R−N) value at peak 1.

3. The vehicle detector of claim 2 wherein K1=40; K2=300; K3=12; K4=400; and K5=12.

4. The vehicle detector of claim 1 wherein said machine readable code is configured to enable said processor to implement a bicycle timer which is activated to count toward a zero value state from a predetermined non-zero value when a first valid peak has been detected by said evaluation unit and to enable said processor to prevent the generation of said "Has Bike" signal by said evaluation unit when said bicycle timer has reached the zero value state before said first set of rules is satisfied.

5. The vehicle detector of claim 1 wherein said machine readable code is further configured to enable said evaluation unit to determine whether a loop disturbance caused by an object entering the vicinity of the loop has occurred and to perform the peak and valley detection and testing so long as the loop disturbance is present.

6. The vehicle detector of claim 5 wherein said machine readable code is further configured to enable said evaluation unit to determine whether a formerly present loop disturbance is no longer present and to generate said "Has Bike" signal when two peaks and one valley satisfy said first set of rules after said formerly present loop disturbance is no longer present.

7. The vehicle detector of claim 6 wherein said machine readable code is further configured to enable said evaluation unit to determine whether a formerly present loop disturbance is no longer present and to generate said "Has Bike" signal when two peaks and one valley do not satisfy said first set of rules but do satisfy a second set of rules after said formerly present loop disturbance is no longer present.

8. The vehicle detector of claim 7 wherein said second set of rules comprises:

Rule 1 (used to detect a first valid peak):

$$K6 \leq \text{peak } 1 \leq K7$$

where K6 is a constant lying in the range from 30-50; peak 1 is the (R−N) value at peak 1; and K7 is a constant lying in the range from 380-420.

Rule 2 (used to detect a valley):

$$\text{Valley} \geq 12$$

where Valley is the (R−N value at the valley)

Rule 3 (used to detect a second valid peak):

$$K6 \leq \text{peak } 2 \leq K7$$

where K6, K7 are as defined above and peak 2 is the (R−N) value at peak 2.

Rule 4:

The valley value is compared with the average value of the two peaks, i.e.

$$\text{Peak Average} = \frac{\text{peak } 1 + \text{peak } 2}{2}$$

If Valley≤0.625 Peak Average, then a bicycle is present and the "Has Bike" flag is set.

9. The vehicle detector of claim 8 wherein K6=40; and K7=400.

10. The vehicle detector of claim 7 wherein said machine readable code is configured to enable said processor to implement a bicycle timer which is activated to count toward a zero value state from a predetermined non-zero value when a first valid peak has been detected by said evaluation unit and to enable said processor to prevent the generation of said "Has Bike" signal by said evaluation unit when said bicycle timer has reached the zero value state before said second set of rules is satisfied.

11. The vehicle detector of claim 1 further including a loop coupled to said oscillator.

12. The vehicle detector of claim 11 wherein said loop is configured in the shape of a parallelogram.

13. The vehicle detector of claim 12 wherein said parallelogram extends across a traffic lane.

14. The vehicle detector of claim 13 wherein said parallelogram has two opposing sides which are substantially coincident with opposing edges of said traffic lane.

15. The vehicle detector of claim 12 wherein said parallelogram has two long parallel legs mutually spaced by an amount which matches the spacing between the front and rear wheels of a bicycle.

16. The vehicle detector of claim 11 wherein said loop has a geometrical configuration capable of producing a bicycle signature having at least two peaks and two valleys.

17. The vehicle detector of claim 11 wherein said loop has a geometrical configuration capable of producing a bicycle signature having at least two peaks and one valley.

* * * * *